United States Patent [19]

Goeppner

[11] Patent Number: 4,785,992

[45] Date of Patent: Nov. 22, 1988

[54] CONTAINER AND METHOD OF MAKING THE SAME

[75] Inventor: Ronald R. Goeppner, Clarendon Hills, Ill.

[73] Assignee: Continental Can Company, Inc., Norwalk, Conn.

[21] Appl. No.: 411,124

[22] Filed: Aug. 24, 1982

[51] Int. Cl.[4] ..... B65D 3/14

[52] U.S. Cl. ..... 229/5.6; 53/478; 156/69; 206/508; 206/509; 229/5.5; 493/109

[58] Field of Search ..... 229/5.5, 5.6, 5.8; 220/67, 78, 79, 66, DIG. 12; 156/69, 198, 216, 294; 493/108, 109, 158, 153, 152, 102, 103, 104; 53/478, 488; 206/508, 509, 503

[56] References Cited

U.S. PATENT DOCUMENTS

| | | | |
|---|---|---|---|
| 1,538,085 | 5/1925 | Brooks | 206/508 |
| 1,650,520 | 11/1927 | Johnson | 206/509 |
| 1,876,484 | 9/1932 | Bedworth | 229/5.6 |
| 2,106,738 | 2/1938 | Harrison | 53/478 |
| 2,370,018 | 2/1945 | Cosmo | 493/108 X |
| 3,116,001 | 12/1963 | Carpenter et al. | 229/5.5 |
| 3,288,342 | 11/1966 | Tinker | 229/5.6 |
| 3,315,865 | 4/1967 | Bracht | 229/5.6 |
| 3,349,956 | 10/1967 | Stephan | 206/508 |
| 4,057,444 | 11/1977 | Prot | 156/69 |

FOREIGN PATENT DOCUMENTS

| | | | |
|---|---|---|---|
| 1408391 | 7/1965 | France | 229/5.6 |
| 115552 | 10/1945 | Sweden | 229/5.5 |

*Primary Examiner*—Stephen Marcus
*Assistant Examiner*—Gary E. Elkins
*Attorney, Agent, or Firm*—Charles E. Brown; Paul Shapiro; Charles A. Brown

[57] ABSTRACT

This relates to a bottom construction for a composite container wherein the container body is of a composite construction such as a wound paper tube having a plastic material liner. The bottom construction includes a generally cup-shaped closure element formed from a plastic material sheet which is molded in situ within the bottom end of the tubular body with the plastic material being heated to a molding temperature with the temperature being such that the plastic material of the closure will self-bond to the plastic material of the liner. The closure is of a generally hat-shaped configuration and includes a central cup portion which is telescoped within the end of the tubular body and which is then provided with a reinforcing disk, after which the extreme end portion of the tubular body is curled or rolled radially inwardly to abut against the underside of the reinforcing disk to complete the bottom construction.

5 Claims, 2 Drawing Sheets

CONTAINER AND METHOD OF MAKING THE SAME

This relates in general to new and useful improvements in container constructions, and more particularly to a container bottom structure.

This invention particularly relates to the forming of a plastic cup end or bottom for a tubular container body which is preferably of a composite construction, i.e. one wherein the body may be of a wound laminated paper construction which may include a barrier layer and wherein the body has a liner formed of a plastic material which may either be a coating or a film or plastic material. In accordance with this invention, one end of the tubular body is provided with a composite end construction which includes generally a plastic cup having a peripheral flange. The cup is preferably molded in situ within the one end of the tubular body and is formed from a sheet of plastic material which is heated and then pressed into the one end of the tubular body using a suitable punch or die member. The plastic material of the liner and the plastic material of the sheet are preferably of a heat bondable material and the sheet is heated to a sufficiently high temperature wherein it is both moldable and heat bondable to the liner.

The closure member formed from the sheet is of a cup shape within the end of the tubular body so that it may receive a reinforcing disk which may be inexpensively formed of paper or like material.

After the disk has been inserted in the cup of the closure, the extreme end portions of the tubular body at the one end thereof are rolled or curled radially inwardly with the peripheral flange of the closure being directed into abutment with the disk.

If desired, the other end of the tubular body, after it has been filled with a product, may be closed utilizing a metal end unit with the same forming portion of the end unit being outwardly flared so as to receive the bottom end of a like next above container in nested or stacked relation.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
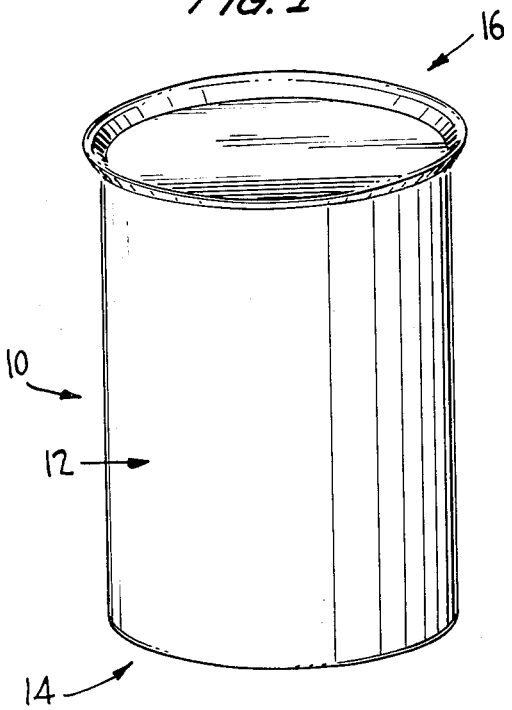
FIG. 1 is a perspective view of a container formed in accordance with this invention.

Referring now to the drawings in detail, it will be that there is illustrated in FIG. 1 a container formed in accordance with this invention. The container is generally identified by the numeral 10 and is of a three-piece construction. The container 10 includes a tubular body 12, a bottom end construction 14, and a top end unit 16.

The tubular body 12 is preferably of a composite construction and may include layers of paper which are spirally wound and bonded together. Further, the paper layers may have incorporated therein a barrier layer formed of a suitable plastic material or a metal foil. The tubular body 12 composite construction is identified by the numeral 16 and carries on the inner surface thereof a plastic material liner 18. The liner 18 normally will be in the form of a film layer of plastic material, although it may be in the form of a plastic material coating.

The first step in forming the container 10 after the desired length tubular body 12 has been formed from a longer or continuous length of tubular stock is to form a bottom construction which closes the bottom end of the tubular body 12 in sealing relation.

Figure 2:
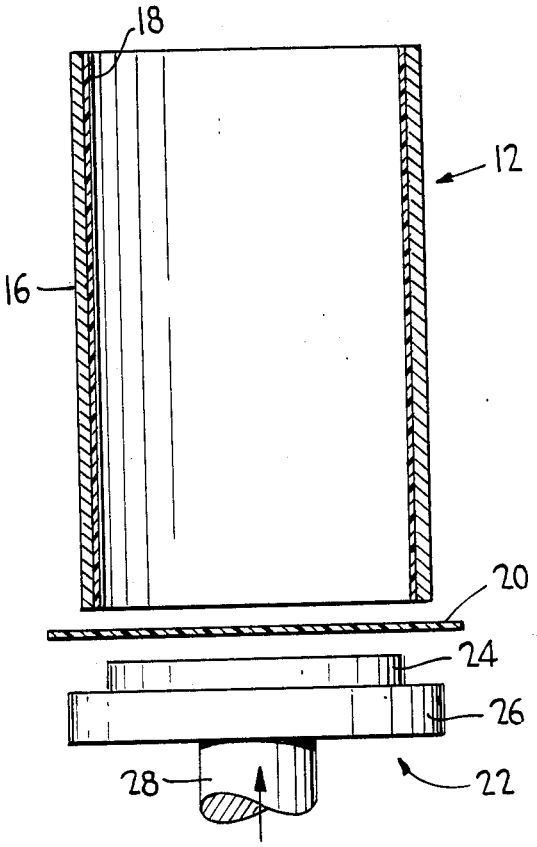
FIG. 2 is a longitudinal sectional view showing the initial relationship of the container tubular body and a plastic material sheet from which a closure is formed.
Figure 3:
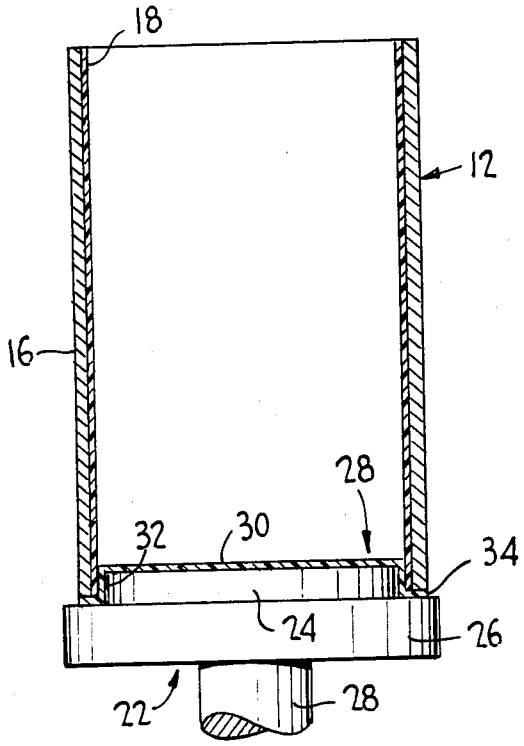
FIG. 3 is a sectional view similar to FIG. 2, and shows a punch or die member having pressed the sheet into the interior of the tubular body at one end to form the necessary closure.
Figure 4:
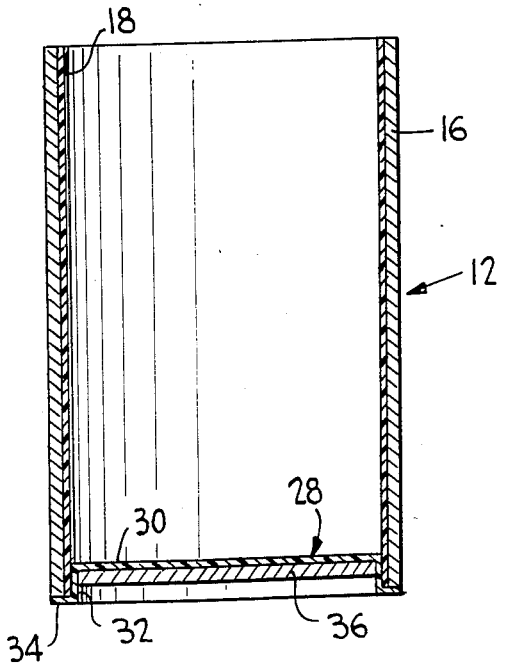
FIG. 4 is another sectional view similar to FIG. 2, and shows the application of a reinforcing disk within the cup-shaped portion of the closure.

As shown in FIG. 2, there is provided a plastic material sheet 20 which may be in the form of an individual blank or which may be an intermediate portion of a continuous web. The plastic material sheet 20 is heated so that it not only may be readily moldable, but also that it may be at such an elevated temperature when applied to the tubular body 12, the plastic material thereof will automatically heat bond to the plastic material of the liner 18.

In accordance with this invention, there is provided a stepped punch or die 22 having a smaller diameter end portion 24 and a larger diameter portion 26 carried by a suitable shaft or rod 27. The diameter of the smaller punch portion 24 is slightly less than the internal diameter of the tubular body 12. When the sheet 20 is heated, it is readily moldable and thus when the punch smaller diameter portion 24 engages the sheet 20 and moves it into the interior of the bottom end of the tubular body 12, the sheet 20 will flow over the smaller diameter punch portion 24 and will be molded within the upper end of the tubular body 12 to form a closure 28. The closure 28 will include an end panel 30 which is recessed within the tubular body 12 and a cylindrical portion 32 which is also recessed within the tubular body 12. It is to be understood that the clearance between the liner 18 and the smaller diameter punch portion 24 is one wherein the pressing of the cylindrical portion 32 of the closure against the liner is assured so that a heat bond may be effected.

The end panel 30 is recessed within the tubular body 12 and together with the cylindrical portion 32 defines a closure of a generally inverted cup shape.

Furthermore, the larger diameter punch 26 carries the outer peripheral portion of the sheet 20 and forces the same against the extreme end of the tubular body 12 to define a peripheral flange 34. It will be seen that the flange 34, together with the cup-shaped central portion of the closure 28, defines what may be considered a hat-shaped closure with the peripheral flange 34 bearing tightly against the extreme end of the tubular body 12 and having a certain degree of bond therewith.

After the closure member 28 has been formed, the tubular body 12 with the closure member 28 applied is moved to a next station wherein a disk 36 is inserted into the cup-shaped portion of the closure member 28 to reinforce the same. The disk 36 is preferably of a paper construction, but may be of a suitable composite construction.

Figure 5:
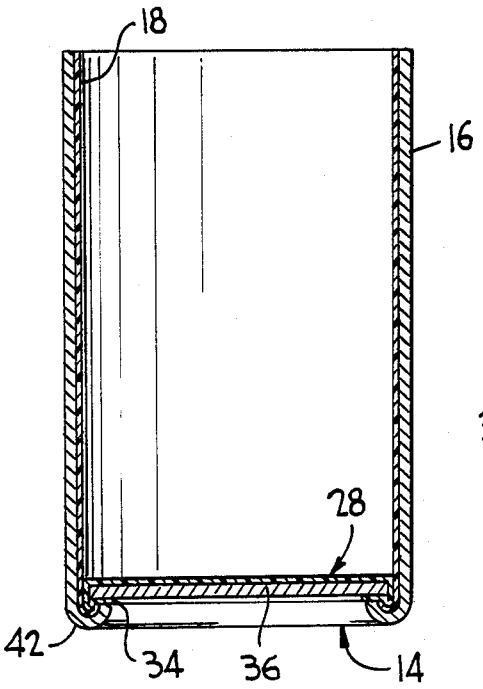
FIG. 5 is another sectional view similar to FIG. 2, and shows the extreme end portion of the tubular body having been rolled or curled radially inwardly to complete the bottom construction.

Finally, the extreme end portion of the tubular body 12 is rolled or curled radially inwardly so that the peripheral flange 34 is brought into opposed facing engagement with the underside of the reinforcing disk 36 as shown in FIG. 5.

Figure 6:
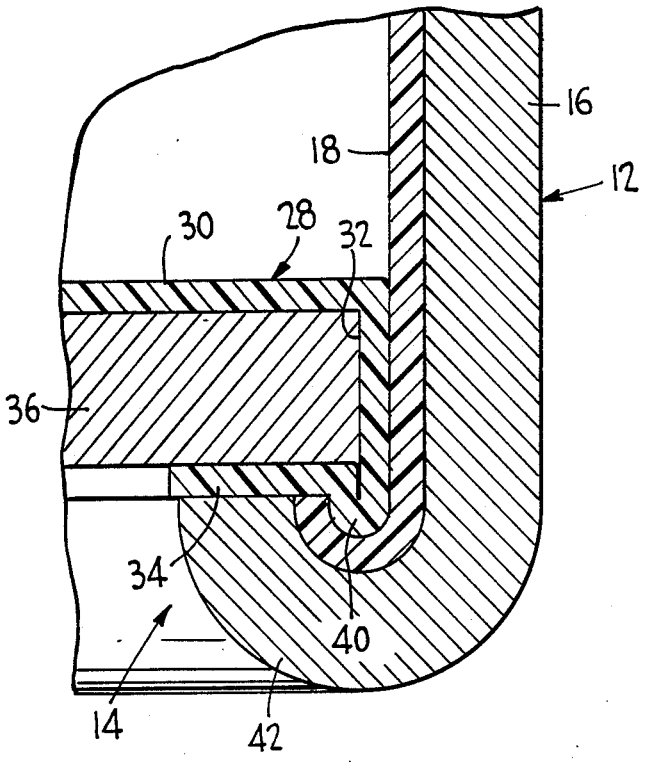
FIG. 6 is an enlarged fragmentary sectional view showing the specifics of the bottom construction.
Figure 7:
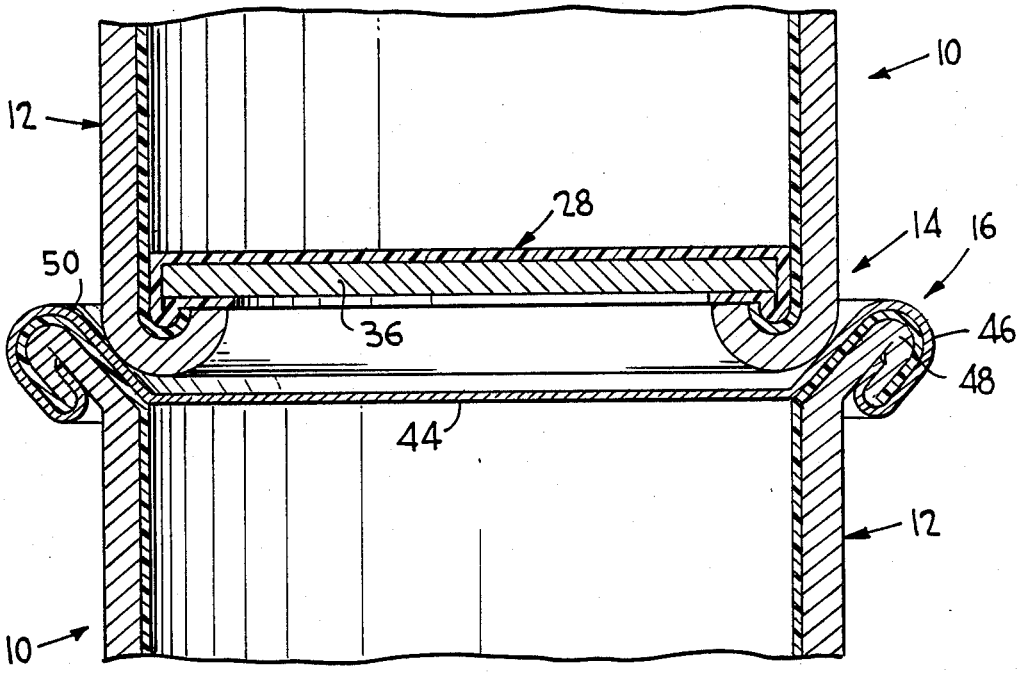
FIG. 7 is a fragmentary sectional view between two containers formed in accordance with the invention with the containers being in stacked relation.

Referring now to FIG. 6, it will be seen that the resultant bottom construction, which is generally identified by the numeral 14, includes a plastic material closure member 28 which is in part defined by an inverted cup-shaped portion. The cup-shaped portion includes an end panel or wall 30 and a cylindrical wall portion 32 with the cylindrical wall 32 being heat bonded to the liner 18 as afore described. That portion of the cylindrical wall 32 which depends below the reinforcing disk 36 is reversely folded upon itself as at 40 and the peripheral flange 34 directly underlies and bears against the reinforcing disk 36. Since the peripheral flange 34 is at a bonding temperature when it is pressed against the underside of the reinforcing disk 36, a certain degree of adhesion occurs. It will be seen that the extreme lower part of the tubular body 12 is completely reversely turned to define a curl 42 which serves positively to anchor the bottom end of the construction 14.

The manner in which the container 10 is closed may vary. However, it is preferred that the top end unit 16 be formed of sheet metal and include an end panel 44 and a peripheral bead portion 46 which is interlocked and rolled or beaded together with an extreme upper part 48 of the tubular body 12. Further, the peripheral bead portion 46 is upwardly and radially outwardly flared to define a tapered seat 50 into which the bottom construction 14 of the container may readily seat.

Although only a preferred embodiment of the container construction has been specifically illustrated and described, it is to be understood that minor variations may be made in the container construction, particularly the bottom construction thereof, without departing from the spirit and scope of the invention as defined by the appended claims.

I claim:

1. A container comprising a cylindrical body having a plastic material interior surface, and a bottom closing an open lower end of said body, said bottom comprising a plastic material closure member telescoped within a bottom portion of said body and being bonded to said plastic material surface, said bottom portion including an extreme bottom part terminating in a transversely extending extreme end, and said extreme bottom part of said body being rolled radially inwardly and axially upwardly beneath said closure member, said closure member having seated therein a reinforcing disk, said extreme end of said body opposing said reinforcing disk, said closure member having a portion positioned between said body extreme end and said reinforcing disk.

2. A container according to claim 1 wherein said closure member has a reversely folded upon itself part within said rolled body extreme bottom part.

3. A container according to claim 2 wherein said closure member is initially of a shape including an end wall, a cylindrical wall extending from said end wall, and a peripheral flange, said end wall and said cylindrical wall being telescoped within said body, and said peripheral flange engaging said body extreme end.

4. A container according to claim 1 wherein said closure member within said body is of an in situ molded inverted cup shape.

5. A method of forming a container having a closed bottom, said method comprising the steps of providing a tubular body having a platic material liner and including an end portion terminating in a transversely extending extreme end which defines an open end, positioning a plastic material sheet across said open end of said tubular body, heating said plastic material sheet, and molding said plastic material sheet to an inverted cup-shaped closure within said tubular body end portion, bonding said plastic material sheet to said plastic material liner, providing said plastic material sheet with a peripheral flange which extends across said extreme end of said tubular body, inserting a stiffening disk into said closure, and rolling said end portion of said tubular body radially inwardly into said closure with said peripheral flange opposing said stiffening disk and lying between said body extreme end and said stiffening disk with said body extreme end pressing said peripheral flange against said stiffening disk.

* * * * *